US005722733A

United States Patent [19]

Tank et al.

[11] Patent Number: 5,722,733

[45] Date of Patent: Mar. 3, 1998

[54] MOUNTING OF CUTTER PICKS

[76] Inventors: Klaus Tank, 9 Warbleton Ave., Essexwold; Arthur Mark Kilfoil, 109 First Ave. Melville, both of Johannesburg, South Africa

[21] Appl. No.: 670,509

[22] Filed: Jun. 27, 1996

[30] Foreign Application Priority Data

Jul. 5, 1995 [ZA] South Africa ..... 95/5589

[51] Int. Cl.[6] ..... E21C 35/18

[52] U.S. Cl. ..... 299/108; 299/112

[58] Field of Search ..... 299/106, 108, 299/112

[56] References Cited

U.S. PATENT DOCUMENTS

| | | | |
|---|---|---|---|
| 3,143,177 | 8/1964 | Galorneau et al. | 299/108 X |
| 4,595,241 | 6/1986 | Gilbert et al. | 299/108 |
| 4,880,278 | 11/1989 | Tomlinson | 299/112 |

FOREIGN PATENT DOCUMENTS

| | | | |
|---|---|---|---|
| 2008170 | 5/1979 | United Kingdom | 299/108 |

*Primary Examiner*—David J. Bagnell

*Attorney, Agent, or Firm*—Scully, Scott Murphy and Presser

[57] ABSTRACT

The invention concerns a cutter pick mounting apparatus which is used to mount a cutter pick (10) to a pick box (12) which is secured to the drum of a mining machine. The cutter pick has a pick body (14) having a base (25) of circular cross-section and a shank (26) of smaller circular cross-section extending from the base. The shank is eccentric with respect to the base. The pick box is formed with a countersunk socket (30) that has a base-receiving recess (32) and a shank-receiving bore (34) which extends from the base of the recess. The bore is eccentric with respect to the recess, the eccentricity (38) corresponding to the eccentricity (28) of the shank of the pick body with respect to the base of the pick body. With this configuration the pick body (14) can be held non-rotatably in the socket (30) with the base locating complementally in the recess and the shank locating complementally in the bore.

7 Claims, 2 Drawing Sheets

MOUNTING OF CUTTER PICKS

BACKGROUND TO THE INVENTION

This invention relates to the mounting of cutter picks on mining machines.

Cutter picks which employ cutting inserts with a composite abrasive compact bonded to a substrate, typically of cemented tungsten carbide, are known. Since cutter picks of this type can only operate unidirectionally when mounted on the rotary drum of a mining machine, it is important that the cutter pick mounting be such as to prevent rotation of the cutter pick.

To prevent rotation of such cutter picks, it has been proposed to form the pick body, in which the cutting insert is secured, with a flat. The socket in the pick box, in which the body is supported, is then formed with a corresponding flat. The interaction of the mating flats then prevents rotation of the pick body in use. However, the formation of a flat in the pick box requires an expensive machining operation.

SUMMARY OF THE INVENTION

According to a first aspect of the invention there is provided a cutter pick mounting apparatus comprising:

a cutter pick including a pick body having a base of circular cross-section and a shank of smaller circular cross-section extending from the base, the shank being eccentric with respect to the base, and a pick box formed with a countersunk socket including a base-receiving recess of circular cross-section and a shank-receiving bore which is also of circular cross-section and which extends from the base of the recess, the bore being eccentric with respect to the recess and the eccentricity of the bore with respect to the recess corresponding to the eccentricity of the shank of the pick body with respect to the base of the pick body, whereby the pick body of the cutter pick is receivable non-rotatably by the socket with the base locating complementally in the recess and the shank locating complementally in the bore.

The pick body carries a cutting insert which is exposed to perform a cutting action in a forward direction in use. Preferably the shank of the pick body is eccentric with respect to the base of the pick body, and the bore of the socket is eccentric with respect to the recess of the socket, in the forward direction.

For added strength it is preferred that the base of the pick body provides a greater bulk of material rearwardly of the axis of the shank than forwardly of that axis. It is also preferred that the pick box includes an upstanding shoulder rearwardly of the recess.

According to a second aspect of the invention there is provided a cutter pick comprising a pick body having a base of circular cross-section and a shank of smaller circular cross-section depending from the base, the shank being eccentric with respect to the base.

According to a third aspect of the invention there is provided a pick box formed with a countersunk socket for receiving the body of a cutter pick, the socket including a recess of circular cross-section for receiving a base of the pick body and a bore of circular cross-section, extending from the base of the recess, for receiving a shank of the pick body which depends from the base of the pick body, the bore being eccentric with respect to the recess.

BRIEF DESCRIPTION OF THE DRAWINGS

The invention will now be described in more detail, by way of example only, with reference to the accompanying drawings in which.

DESCRIPTION OF A PREFERRED EMBODIMENT

The illustrated cutter pick mounting apparatus is designed for use with a mining machine of rotary drum type. The apparatus includes a cutter pick 10 and a pick box 12. In use, the pick box 12 is mounted to the periphery of the cutting drum of the mining machine, and the cutter pick is mounted releasably and non-rotatably in the pick box.

Figure 1:
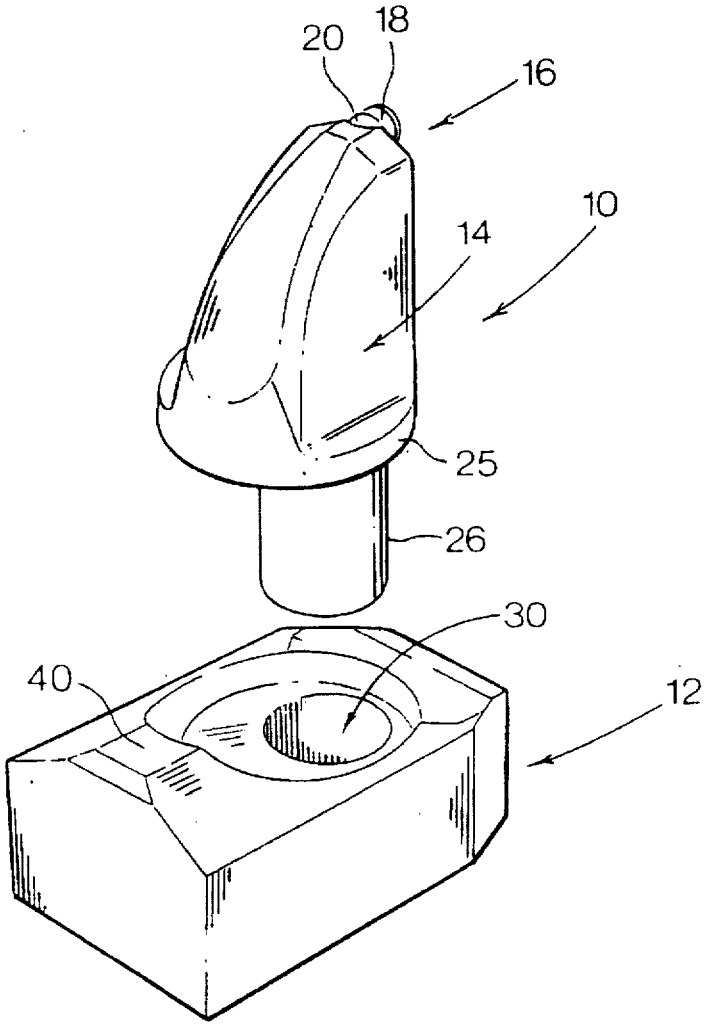
FIG. 1 shows an exploded perspective view of a cutter pick mounting apparatus according to the invention.
Figure 2:
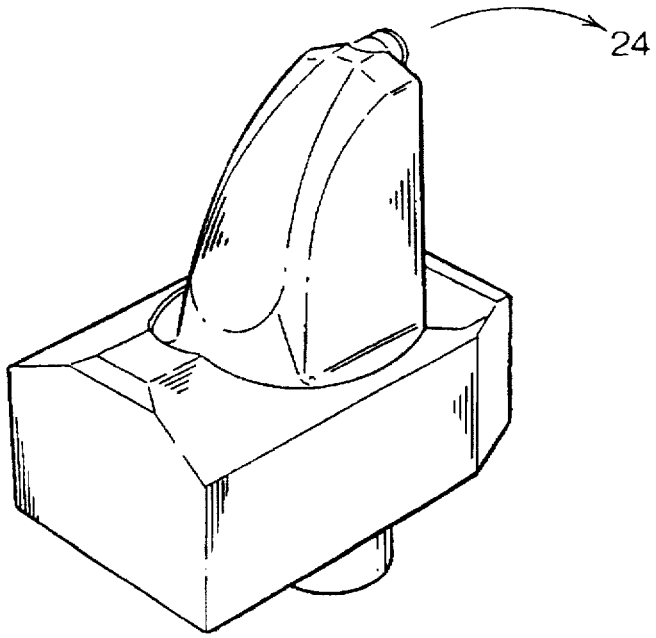
FIG. 2 shows a perspective view of the mounting apparatus in an assembled condition.

Referring to FIGS. 1 and 2, the cutter pick 10 has a steel pick body 14 and a cutting insert 16. The cutting insert 16 has a composite abrasive compact 18 secured to a shank 20 which is in turn secured in a pocket 22 in the pick body. In a typical case, the composite abrasive compact 18 includes a layer of PCD (polycrystalline diamond) on a cemented tungsten carbide backing and the backing is secured to the shank 20, which is also of cemented tungsten carbide. The various components are secured to one another by conventional brazing or other techniques which are well known to those skilled in the art.

The composite abrasive compact is exposed at the tip of the cutter pick 10 so as, in use, to perform a cutting action in a forward direction indicated by the numeral 24 in FIG. 2 when the cutter drum of the mining machine is rotated.

It will be appreciated that the geometry of the cutter pick is such that it is only capable of performing an efficient cutting action if it is correctly aligned with respect to the forward cutting direction 24, and that it should not be allowed to rotate out of this alignment.

Figure 4:
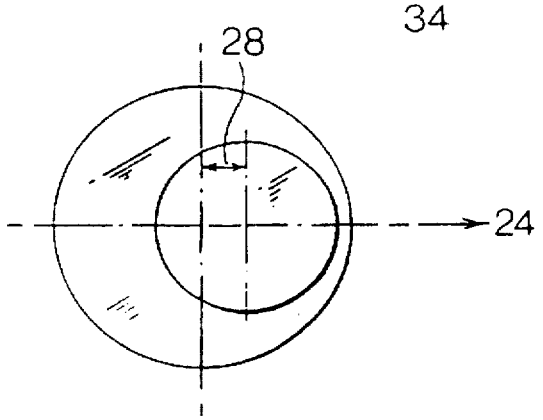
FIG. 4 shows an end view of the cutter pick, in a direction looking at the end of the shank.

The pick body 14 has a base 25 of circular cross-section and a shank 26, also of circular cross-section, extending integrally from the base. As illustrated, the shank is eccentric with respect to the base, the eccentricity being indicated by the numeral 28 in FIG. 4. It will be noted that the eccentricity of the shank is in the forward cutting direction 24, so that there is a considerable bulk of steel material located behind the cutting insert 16.

Figure 3:
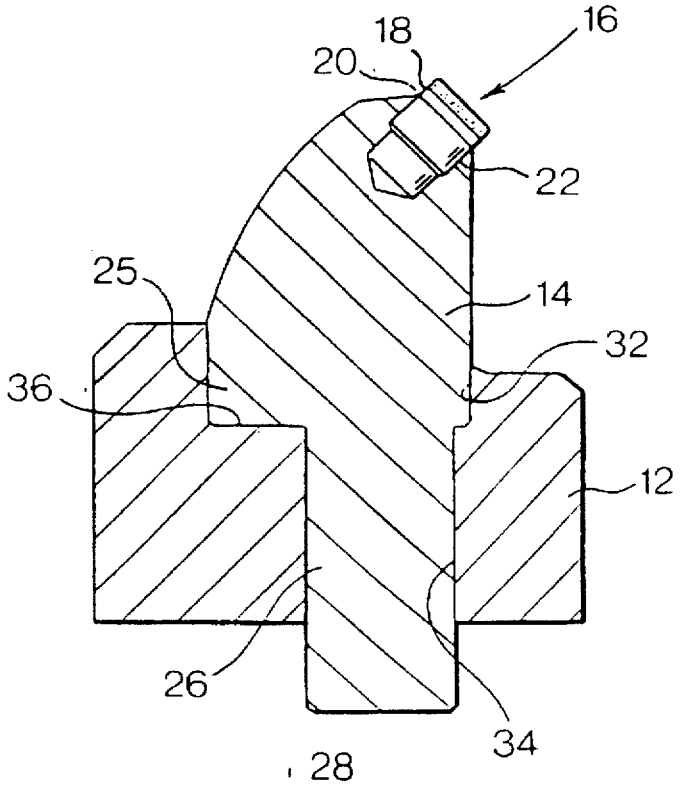
FIG. 3 shows a partial cross-sectional view of the assembly seen in FIG. 2.
Figure 5:
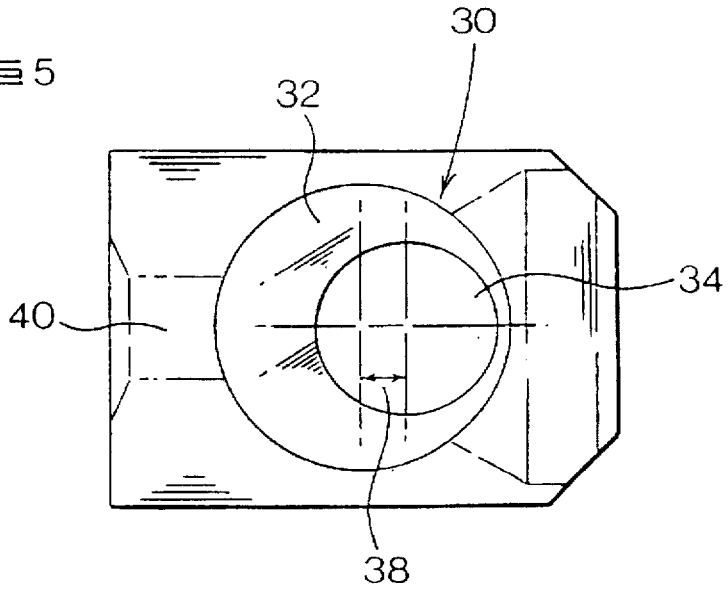
FIG. 5 shows a view of the pick box, in a direction looking into the socket.

Referring to FIGS. 1, 3 and 5 the steel pick box 12 is formed with a countersunk socket 30. The socket 30 includes a circular recess 32 and a circular bore 34 which extends from the base 36 of the recess through the pick box. The bore is eccentric with respect to the recess, the eccentricity being indicated in FIG. 5 by the numeral 38. It will be observed from the various Figures that the eccentricity 38 is in the forward cutting direction. At its rear end, the pick box includes an upstanding shoulder 40.

The diameter of the recess 32 is marginally greater than the diameter of the base 25 and the diameter of the bore 34 is marginally greater than the diameter of the shank 26. The eccentricities 28 and 38 are the same. With this configuration the pick body 14 can be slipped into the socket 30 with the base 25 locating complementally in the recess 32 and the shank 26 locating complementally in the bore 34, as illustrated in FIG. 3. As will also be apparent from this Figure, the end 42 of the shank protrudes through the end of the bore. In practice, a resilient clip or other fastening device, which forms no part of the present invention, can be engaged with the protruding end of the shank to prevent removal of the pick body from the socket.

The eccentricity of the shank with respect to the base and of the shank-receiving bore with respect to the base-receiving recess ensures that the pick body cannot rotate in the socket 30. This in turn ensures that the cutting element 16 is always correctly aligned to perform a cutting action in the forward cutting direction 24.

A major advantage of the eccentric configuration described above is the fact that the recess and bore of the socket 30 can be formed entirely with conventional steel boring machinery. No further machining of flats or the like is required to ensure non-rotation of the cutter pick in the pick box. There is also no need to machine special flats or the like on the pick body.

Added to this, the illustrated configuration ensures that the bulk of steel material in the pick body is behind the cutting element 16, thereby providing a strong support for the cutting element in a region which is typically subjected to high stresses in operation. Similarly, the upstanding shoulder 40 of the pick box places a substantial amount of material behind the pick body and provides strong support for the pick body.

We claim:

1. A cutter pick mounting apparatus comprising:

a cutter pick including a pick body carrying a cutting insert exposed to perform a cutting action in a forward direction in use, the pick body having a base of circular cross-section and a shank of smaller circular cross-section extending from the base, the shank being eccentric with respect to the base in the forward direction and pick box formed with a countersunk socket including a base-receiving recess of circular cross-section and a shank-receiving bore which is also of circular cross-section and which extends from the base of recess, the bore being eccentric with respect to the recess in the forward direction and the eccentricity of the bore with respect to the recess corresponding to the eccentricity of the shank of the pick body with respect to the base of the pick body, whereby the pick body of the cutter pick is receivable non-rotatably by the socket with the base locating complementally in the recess and the shank locating complementally in the bore.

2. A cutter pick mounting apparatus according to claim 1 wherein the base of the pick body provides a greater bulk of material rearwardly of the axis of the shank than forwardly of that axis.

3. A cutter pick mounting apparatus according to claim 2 wherein the pick box includes an upstanding shoulder rearwardly of the recess.

4. A cutter pick comprising a pick body carrying a cutting insert which is exposed to perform a cutting action in a forward direction in use, the pick body having a base of circular cross-section and a shank of smaller circular cross-section depending from the base, the shank being eccentric with respect to the base in the forward direction.

5. A cutter pick according to claim 4 wherein the base of the pick body provides a greater bulk of material rearwardly of the axis of the shank than forwardly of that axis.

6. A pick box formed with a countersunk socket adapted to receive the body of a cutter pick with the cutter pick orientated for an exposed cutting insert which it carries to perform a cutting action in a forward direction in use, the socket including a recess of circular cross-section for receiving a base of the pick body and a bore of circular cross-section, extending from the base of the recess, for receiving a shank of the pick body which depends from the base of the pick body, the bore being eccentric with respect to the recess in the forward direction.

7. A pick box according to claim 6 wherein the pick box includes an upstanding shoulder rearwardly of the recess.

* * * * *